US008651723B2

(12) United States Patent
Juestel et al.

(10) Patent No.: US 8,651,723 B2
(45) Date of Patent: Feb. 18, 2014

(54) LED LIGHT SOURCE WITH A LUMINESCENT LAYER

(75) Inventors: Thomas Juestel, Witten (DE); Jacqueline Merikhi, Aachen (DE); Henning Ohland, Aachen (DE); Joachim Opitz, Aachen (DE); Harald Josef Guenther Radermacher, Aachen (DE); Detlef Uwe Wiechert, Alsdorf (DE)

(73) Assignee: Koninklijke Philips N.V., Eindhoven (NL)

( * ) Notice: Subject to any disclaimer, the term of this patent is extended or adjusted under 35 U.S.C. 154(b) by 668 days.

(21) Appl. No.: 12/867,895

(22) PCT Filed: Feb. 18, 2009

(86) PCT No.: PCT/IB2009/050650

§ 371 (c)(1),
(2), (4) Date: Nov. 2, 2010

(87) PCT Pub. No.: WO2009/104136

PCT Pub. Date: Aug. 27, 2009

(65) Prior Publication Data

US 2011/0037415 A1 Feb. 17, 2011

(30) Foreign Application Priority Data

Feb. 21, 2008 (EP) ..... 08101827

(51) Int. Cl.
*F21V 7/04* (2006.01)

(52) U.S. Cl.
USPC ..... 362/613; 362/231; 362/84; 362/276; 315/318; 315/312; 315/294; 315/297

(58) Field of Classification Search
USPC ..... 315/312, 318, 307, 297, 294, 291; 362/84, 227, 231, 249.02, 276, 362/611–613; 313/486, 503
See application file for complete search history.

(56) References Cited

U.S. PATENT DOCUMENTS

| | | | | |
|---|---|---|---|---|
| 5,998,925 | A | 12/1999 | Shimizu et al. | |
| 6,149,283 | A * | 11/2000 | Conway et al. | 362/236 |
| 6,528,954 | B1 * | 3/2003 | Lys et al. | 315/291 |
| 6,767,111 | B1 | 7/2004 | Lai | |
| 6,814,470 | B2 * | 11/2004 | Rizkin et al. | 362/327 |
| 7,213,940 | B1 | 5/2007 | Van De Ven et al. | |
| 7,791,265 | B2 * | 9/2010 | Fiedler et al. | 313/501 |
| 7,902,560 | B2 * | 3/2011 | Bierhuizen et al. | 257/82 |
| 8,100,552 | B2 * | 1/2012 | Spero | 362/231 |
| 8,434,924 | B1 * | 5/2013 | Hamburgen et al. | 362/612 |

(Continued)

FOREIGN PATENT DOCUMENTS

| | | | |
|---|---|---|---|
| DE | 20121470 | U1 | 10/2002 |
| DE | 102004004947 | A1 | 8/2005 |

(Continued)

*Primary Examiner* — Haiss Philogene
(74) *Attorney, Agent, or Firm* — David Zivan; Mark L. Beloborodov

(57) ABSTRACT

The invention relates to GLS-look-alike LED light source (100) comprising two different types of LEDs (21, 22), preferably LEDs emitting with a near UV spectrum and a blue or white spectrum, respectively. The light source (100) further preferably comprises a transparent bulb (40) with a shape similar to an incandescent lamp that is coated by a luminescent layer (30) to achieve a white lamp spectrum. The luminescent layer may contain one or two luminescent compositions.

16 Claims, 4 Drawing Sheets

(56) References Cited

U.S. PATENT DOCUMENTS

| | | | | |
|---|---|---|---|---|
| 2005/0127381 | A1 | 6/2005 | Vitta et al. | |
| 2006/0181192 | A1* | 8/2006 | Radkov et al. | 313/486 |
| 2007/0045761 | A1 | 3/2007 | Basin et al. | |
| 2007/0170842 | A1* | 7/2007 | Bokor et al. | 313/503 |
| 2007/0236959 | A1* | 10/2007 | Tolbert et al. | 362/616 |
| 2007/0258240 | A1 | 11/2007 | Ducharme et al. | |
| 2007/0267983 | A1* | 11/2007 | Van De Ven et al. | 315/294 |
| 2008/0035888 | A1* | 2/2008 | Ceintrey et al. | 252/301.6 S |
| 2008/0037282 | A1* | 2/2008 | Kurihara | 362/618 |
| 2008/0130285 | A1* | 6/2008 | Negley et al. | 362/257 |
| 2009/0279283 | A1* | 11/2009 | Schrama et al. | 362/97.2 |

FOREIGN PATENT DOCUMENTS

| | | | |
|---|---|---|---|
| DE | 102005020695 | A1 | 12/2005 |
| JP | 2003051209 | | 2/2003 |
| JP | 2003305058 | A | 10/2003 |
| JP | 2005190899 | | 7/2005 |
| JP | 2006128456 | | 5/2006 |
| JP | 2006156187 | | 6/2006 |
| WO | 0057490 | A1 | 9/2000 |
| WO | 0063977 | A1 | 10/2000 |
| WO | 03080763 | A1 | 10/2003 |
| WO | 2006035349 | A2 | 4/2006 |
| WO | 2007114614 | A1 | 10/2007 |
| WO | WO 2007148303 | A2 * | 12/2007 |

* cited by examiner

LED LIGHT SOURCE WITH A LUMINESCENT LAYER

FIELD OF THE INVENTION

The invention relates to a white light source comprising at least two light emitting diodes (LEDs).

BACKGROUND OF THE INVENTION

The WO 0063977 A1 discloses a light source comprising blue LEDs in a transparent incandescent lamp bulb. The light source further comprises a converter material arranged in a spiral like the filament of a conventional incandescent lamp and a reflective coating disposed on the inside of the transparent bulb.

SUMMARY OF THE INVENTION

Based on this background it was an object of the present invention to provide an alternative light source having the appearance of a GLS (General Lighting Services) lamp, wherein it is desirable that this light source is well suited for indoor applications while having a lower power consumption than conventional incandescent lamps and providing a tunable color temperature.

This object is achieved by a white LED light source according to claim 1 and a white LED light source according to claim 4. Preferred embodiments are disclosed in the dependent claims.

The white LED light source according to a first aspect of the present invention comprises the following components:

a) A transparent bulb through which the light source can emit its light. At least a part of the bulb may optionally have a reflective coating.

b) At least one first LED and one second LED, wherein these at least two LEDs are of different type (i.e. of different emission characteristics) and are mounted in the aforementioned bulb.

c) A luminescent layer disposed on the surface (typically the inside) of the bulb, covering the whole surface or at least a part of it and being capable of converting light from the first and/or the second LED into a different (usually longer) wavelength.

The bulb of the light source has preferably a GLS look-alike shape, for example a shape like a sphere/ellipsoid or a pear. The bulb may also have a conical shape known under the terms reflector lamp or PAR lamp, particularly if it is (partly) covered with a reflective coating. The bulb is preferably equipped with a standard socket for conventional incandescent lamps.

The described light source has the advantage to use power-efficient, robust and inexpensive LEDs as primary light sources while allowing to be designed with an appearance and behavior like a conventional incandescent lamp. The use of two different LEDs and of an additional luminescent layer allows to archieve an overall emission spectrum with excellent properties. As the luminescent layer is disposed on the surface of the bulb, no additional carrier for the luminescent material is necessary, and the emission can be made spatially very homogeneous.

According to a second aspect, the invention comprises a white LED light source with the following components:

a) At least one near UV emitting first LED and one second LED of different type that both can selectively (i.e. independently of each other) be controlled.

b) A red emitting luminescent layer disposed on a surface that is irradiated by the two LEDs.

Optionally, this white LED light source may additionally have the features of the LED light source according to the first aspect of the invention, i.e. the luminescent layer may be disposed on a transparent bulb.

The total light output of the second LED light source depends in a favorable way on the individual activities of the first and second LED, as it is a mixture of both the direct LED lights and the red light of the excited luminescent layer. By selectively controlling the two LEDs, the overall light output can therefore be tuned as desired. The red emitting luminescent layer may for example comprise a luminescent material according to claim 10 (e.g. $LiEuMo_2O_8$), which has a stable emission spectrum regardless of the excitation wavelength and is excitable by UV (e.g. 395 nm) and by light of the second LED if this is assumed to cover the range of about 465 nm (used e.g. in some white LEDs) or other spectral ranges where the phosphor material can be excited, e.g. about 540 nm (cf. FIG. 2). As a result, the $LiEuMo_2O_8$ layer disposed in a remote location (e.g. inside a bulb) is excited by the emission of both LEDs. Varying the intensity balance between the LEDs then changes the mixed light output (comprising a wanted leakage light of white LEDs and UV). Optionally, a green to yellow emitting luminescent layer can be added that is less excitable by UV.

In the following, various optional embodiments of the invention are described that relate to LED light sources according to both the first and second aspect of the invention.

Thus the LEDs of the light source are preferably mounted on a heat sink for efficiently removing dissipated power during the operation of the lamp.

According to a preferred embodiment of the invention, the first LED is a near ultraviolet (UV) emitting LED, particularly an LED with an emission peak in a range from about 370 nm to about 400 nm.

In another embodiment of the invention, which may preferably be combined with the aforementioned one, the second LED is a blue emitting LED, particularly an LED with an emission peak in the range from about 400 nm to about 480 nm. Upon dimming, the blue LED reduces both the color temperature (warm-white appearance) and the overall brightness, as desirable in the application. Alternatively, the second LED may be a green emitting LED, particularly an LED with an emission peak in the range from about 520 nm to about 560 nm According to still another embodiment of the invention, the second LED is a white emitting phosphor converted LED or a green emitting phosphor converted LED. Such an LED may particularly be combined with the mentioned near UV emitting first LED.

The luminescent layer comprises preferably at least one luminescent material that has an absorption characteristic which fits to the emission spectrum of one or both of the two LEDs, preferably to the one which emits at higher energy. The layer may optionally comprise two different luminescent materials, each of which fits optimal to one of the two LEDs.

The luminescent layer may particularly comprise a red emitting luminescent material, for instance a material comprising a composition in accordance to the general formulas $(Sr_{1-x-y}Ca_xBa_y)_{2-z}Si_5N_8:Eu_z$ ($0 \le x \le 1$, $0 \le y \le 1$, $0.1 \le z \le 2$), $(Sr_{1-x}Ca_x)S:Eu$ ($0 \le x \le 1$), $(Sr_{1-x-y}Ca_xBa_y)_{3-z}Si_2N_2O_4:Eu_z$ ($0 \le x \le 1$, $0 \le y \le 1$, $0.1 \le z \le 3$), $CaAlSiN_3:Eu$, $MLn_{1-z}(Mo_{1-x},W_x)_2O_8:Eu_z$ (with M=Li, Na, K, Rb, Cs and Ln=Y, La, Ga and $0 \le x \le 1$, $0.1 \le z \le 1$), $Ln_{2-z}(Mo_{1-x}W_x)_2O_9:Eu_z$ (with Ln=La, Gd, Lu and $0 \le x \le 1$, $0.2 \le z \le 2$), or $Ln_{2-z}(Mo_{1-x}W_x)_3O_{12}:Eu_z$ (with Ln=La, Gd, Lu and $0 \le x \le 1$, $0.2 \le z \le 2$).

According to another embodiment of the invention, the luminescent layer comprises a green to yellow emitting luminescent material, particularly a material comprising a composition in accordance to the general formulas $(Sr_{1-x-y}Ca_xBa_y)_2SiO_4$:Eu ($0 \le x \le 1$, $0 \le y \le 1$), $(Sr_{1-x},Ca_x)Si_2N_2O_2$:Eu ($0 \le x \le 1$), $SrLi_2SiO_4$:Eu, $(Y_{1-x-y-z}Lu_xGd_yTb_z)_3(Al_{1-a}Ga_a)_5O_{12}$:Ce ($0 \le a \le 1$, $0 \le x \le 1$, $0 \le y \le 1$, $0 \le z \le 1$), $Y_3Al_{5-x}Si_xO_{12-x}N_x$:Ce, or $CaAlSiN_3$:Ce.

The LED light source is further preferably designed in such a way that it shows a red-shift in its overall emission spectrum upon dimming (i.e. upon decreasing the electrical power supply to both LEDs or at least to the second LED). This makes the light source particularly apt for indoor lighting purposes where a dimming behavior like that of an incandescent lamp is desired.

The LED light source is preferably coupled to a control and power supply unit for individually controlling the power delivered to the first LED and the second LED, respectively. Thus an independent control of brightness and color of the light source becomes possible.

The aforementioned control and power supply unit is preferably adapted to a) reduce the power delivered to one of the at least two LEDs, and b) keep the power delivered to the other of the at least two LEDs substantially constant when the light source is set to a dimming state.

These and other aspects of the invention will be apparent from and elucidated with reference to the embodiment(s) described hereinafter. These embodiments will be described by way of example with the help of the accompanying drawings in which:

BRIEF DESCRIPTION OF THE DRAWINGS

Like reference numbers in the Figures refer to identical or similar components.

DETAILED DESCRIPTION OF EMBODIMENTS

Inorganic LEDs enable light sources with new features, such as arbitrary color tuning or arbitrary dimming without flickering. Since inorganic LEDs typically emit a single color, it is possible to combine red, green and blue LEDs and blend the emitted light by means of a secondary optic to obtain a dynamically controllable light source. This concept yields thus very efficient and color-tunable light sources, but a high color rendering index (CRI) can only be obtained by application of four or five different LED types, e.g. by the combination of red, orange, yellow, green, and blue LEDs, due to the rather narrow emission bands of AlInGaP and AlInGaN LEDs. This is a serious drawback, since the complexity of the required driving electronics increases with the number of LED types. To avoid these problems, it is possible to base a white LED light source on a single LED type, e.g. blue emitting InGaN dies, and a color converter, comprising one or two luminescent compositions, e.g. YAG:Ce and CaS:Eu.

In order to reduce energy consumption by lighting, the replacement of the GLS (General Lighting Services) lamp by other light sources, in particular by energy saving lamps (CFLi) or LEDs, is highly desirable. However, the light of the CFLi lamps is often perceived much different from GLS lamps (uncomfortable) because of their different color point and the quite different emission spectra.

The present invention therefore proposes an LED light source with two LED types and a luminescent layer which comprises one or two luminescent compositions. The light source preferably has a GLS-look-alike shape, and its components (LEDs, phosphors) are selected in such a way, that the resulting LED lamp shows a red-shift of the white color point upon dimming.

Figure 1:
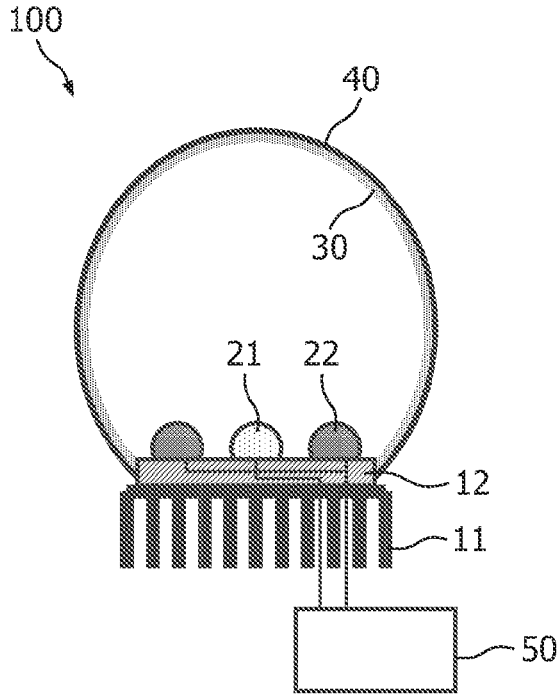
FIG. 1 shows schematically a sectional view through an LED light source according to the present invention.

An exemplary embodiment of such an LED light source 100 is schematically shown in FIG. 1 and comprises:

- Two different types of LEDs 21, 22 as primary light sources; typically there is a number of three to twelve LEDs, mounted on an LED mount 12 in combination with a heat sink 11.
- A glass or plastic (transparent polymer) bulb 40 with a shape similar to an incandescent lamp.
- A luminescent layer 30 coated onto the inside of the bulb 40 to achieve a white lamp spectrum.

The two LEDs 21, 22 are connected to a control and power supply unit 50 (which may be considered as a part of the light source 100 or as an external component) by which they are individually supplied with power. Moreover, it should be noted that the bulb is not a necessary component of the lamp as the luminescent layer might also be disposed on another surface.

Figure 4:
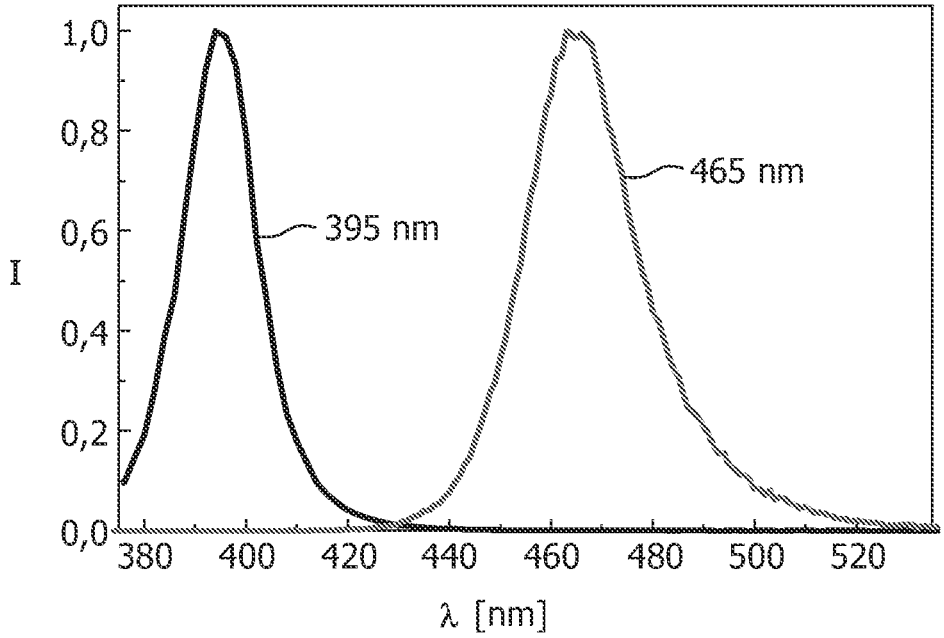

The first LED 21 is of a near UV LED type, with an emission peak between 370 and 400 nm. A typical spectrum for this LED with an emission peak at 395 nm is shown by the left curve in the diagram of FIG. 4 (vertical axis: normalized emission intensity I; horizontal axis: wavelength $\lambda$).

The second LED 22 may be a blue LED with peak emission between 460 and 470 nm. A typical spectrum for this LED with a peak at 465 nm is shown by the right curve in FIG. 4.

Figure 3:
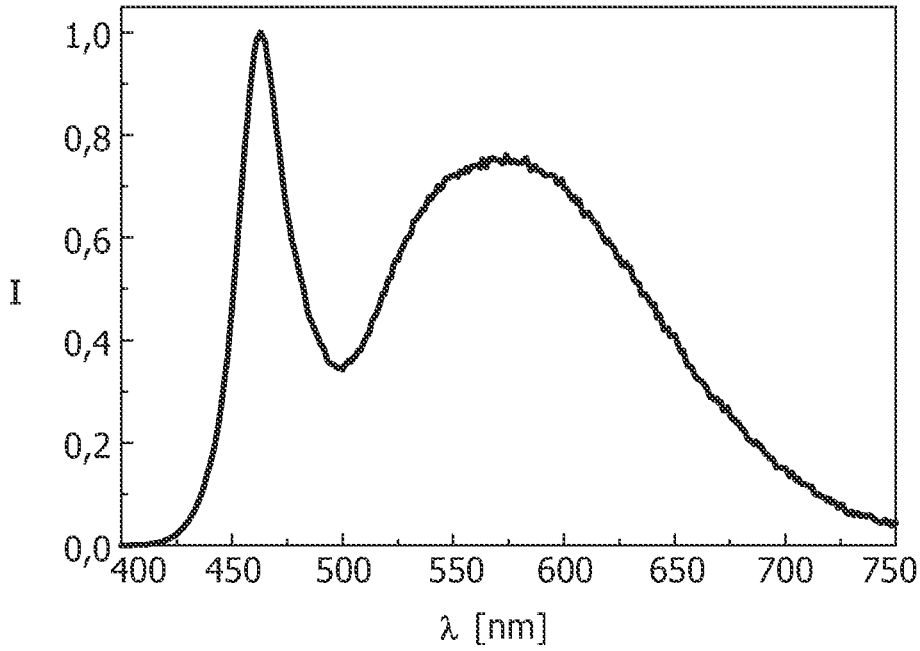
FIGS. 3 and 4 show emission spectra of LEDs that can be used in the LED light source.

Alternatively, the second LED 22 may be a white phosphor converted LED comprising a garnet type phosphor according to the formula $(Y_{1-x-y-z}Lu_xGd_yTb_z)_3(Al_{1-a}Ga_a)_5O_{12}$:Ce. The emission spectrum of a cool white emitting phosphor converted LED comprising $(Y,Gd)_3Al_5O_{12}$:Ce is shown in FIG. 3 (x=0.360, y=0.378, Tc=4600 K).

The luminescent layer 30 may comprise one or two luminescent compositions. If only one luminescent composition is present as coating 30 of the glass bulb 40, its response is optimized to the emission spectrum of that LED type which emits at higher energy. If two luminescent compositions are applied, the response of the first luminescent composition is optimized to the first LED type and the response of the second luminescent composition is optimized to the second LED type.

Figure 2:
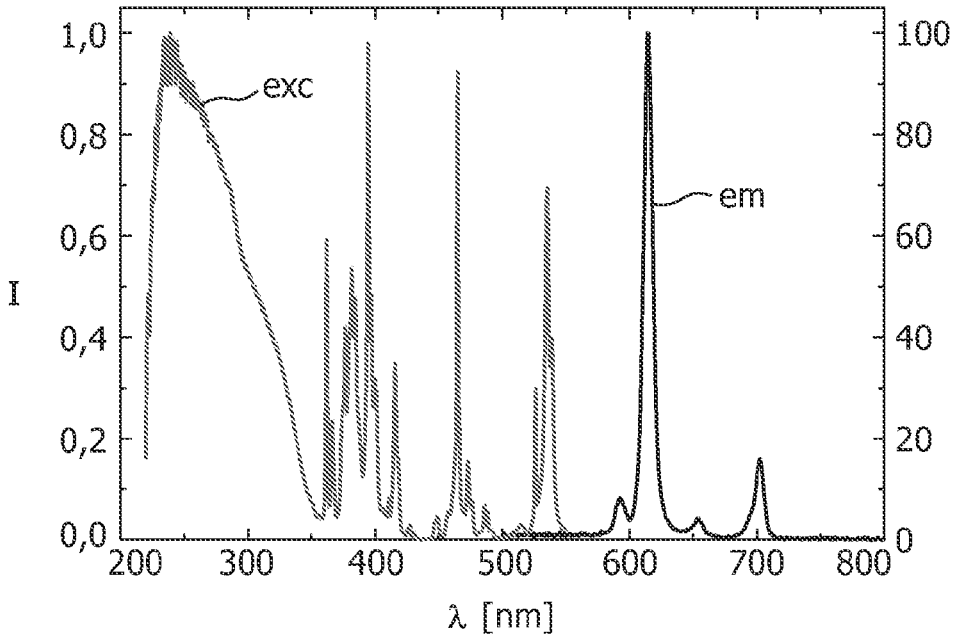
FIG. 2 shows the absorption and emission spectrum of a luminescent material that can be used as coating on the inside of the bulb of the LED light source.

FIG. 2 shows the emission spectrum (em) and excitation spectrum (exc) of a typical red line emitting phosphor ($LiEuMo_2O_8$) excitable in a wide range, e.g. by near UV LEDs (370-400 nm) and by 465 nm or 540 nm, which can be used as a component of the luminescent layer 30.

The following options for the construction of the LED light source 100 are particularly preferred:

a) UV+blue LED:

The first embodiment of an LED light source comprises near UV LEDs 21 (370-400 nm) and blue LEDs 22 (460-470 nm) and a luminescent layer 30 with two luminescent compositions.

The first luminescent composition is a green to yellow-orange emitting phosphor (emitting for example more than about 50% of its energy in the range of 520-580 nm) efficiently luminescent upon 460-470 nm excitation according to one of the following formulas:

$(Sr_{1-x-y},Ca_xBa_y)_2SiO_4$:Eu $(Sr_{1-x},Ca_x)Si_2N_2O_2$:Eu $SrLi_2SiO_4$:Eu $(Y_{1-x-y-z}Lu_xGd_yTb_z)_3(Al_{1-a}Ga_a)_5O_{12}$:Ce $Y_3Al_{5-x}Si_xO_{12-x}N_x$:Ce $CaAlSiN_3$:Ce

The second luminescent composition is a red emitting phosphor (600-680 nm) efficiently luminescent upon 370-400 nm excitation according one of the following formulas:

$(Sr_{1-x-y},Ca_xBa_y)_2Si_5N_8$:Eu $(Sr_{1-x},Ca_x)S$:Eu $(Sr_{1-x-y},Ca_xBa_y)_3Si_2N_2O_4$:Eu $CaAlSiN_3$:Eu $MEu(Mo_{1-x}W_x)_2O_8$(with M=Li,Na,K,Rb,Cs)

$Ln_2(Mo_{1-x}W_x)_2O_9$:Eu(with Ln=La,Gd,Lu)

$Ln_2(Mo_{1-x}W_x)_3O_{12}$:Eu(with Ln=La,Gd,Lu)

Figure 5:
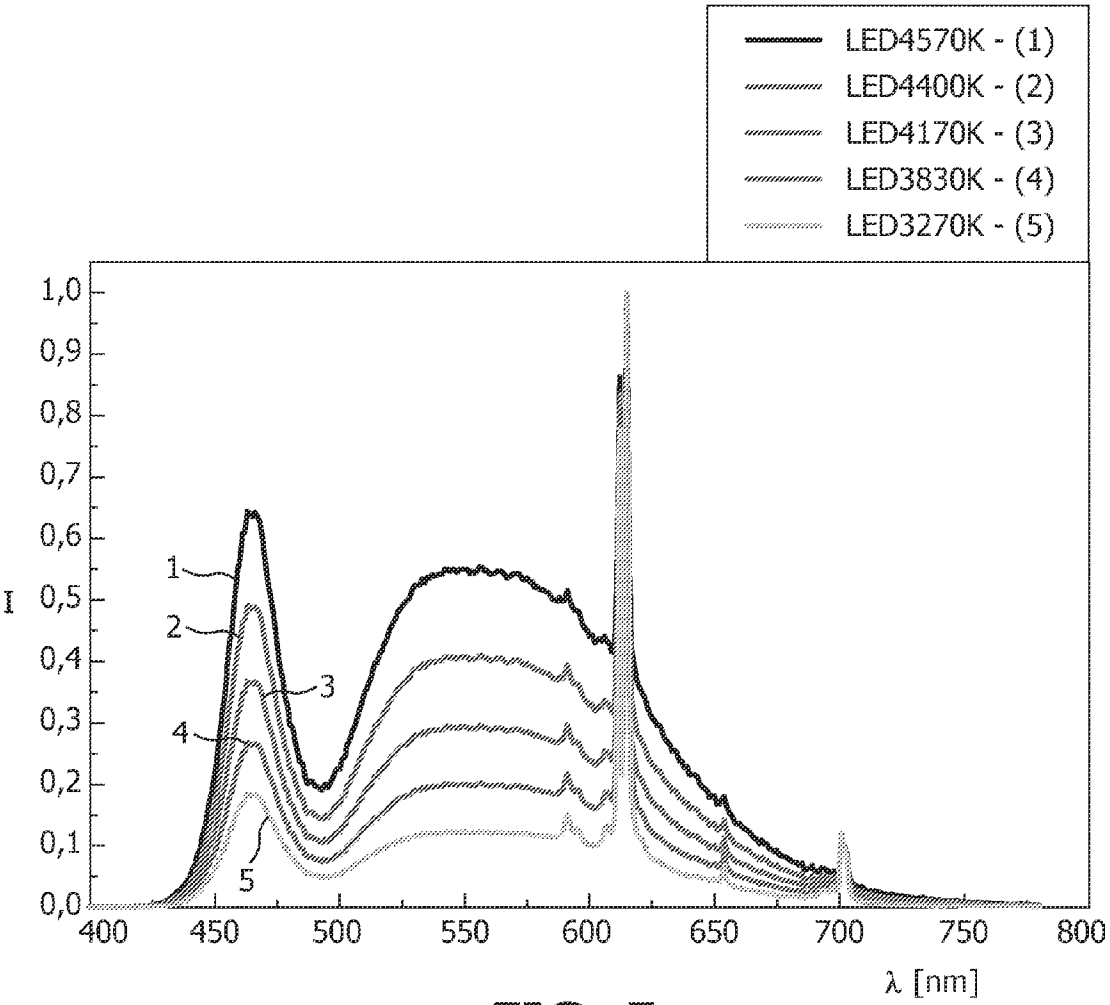
FIGS. 5 and 6 show overall emission spectra of light sources according to the present invention for different degrees of dimming.

FIG. 5 shows emission spectra of such a white LED light source with 465 nm emitting (In,Ga)N LEDs, 395 nm emitting (In,Ga)N LEDs, and a luminescent layer comprising $Y_3Al_5O_{12}$:Ce and $LiEuMo_2O_8$ as function of the driving conditions. For this Figure, it is assumed that all the UV light is absorbed by the luminescent layer or the bulb.

Dimming the blue LEDs reduces both the color temperature and the overall brightness, as desirable in the application. This is achieved by the following fact: The excitation energy in the UV-range is kept at a stable level because only the blue LEDs are dimmed while the UV LEDs are driven at a constant power. The wavelengths of the LEDs and the excitation spectra of the red emitting material are arranged in a way that the emission due to the UV excitation is dominant with respect to the emission due to the blue excitation. Hence, there is a significant reduction of the blue and yellow to green emission (garnet phosphors) while the red emission (e.g. $LiEuMo_2O_8$) is substantially stable. The color rendering index is for all color temperatures between 80 and 85.

b) UV+white LED:

The second embodiment of an LED light source comprises near UV LEDs 21 (370-400 nm) and white LEDs 22 (460-470 nm chip+a yellow garnet type phosphor) and a luminescent layer comprising only one luminescent composition. This luminescent composition is a red band or line emitting phosphor as mentioned above.

Figure 6:
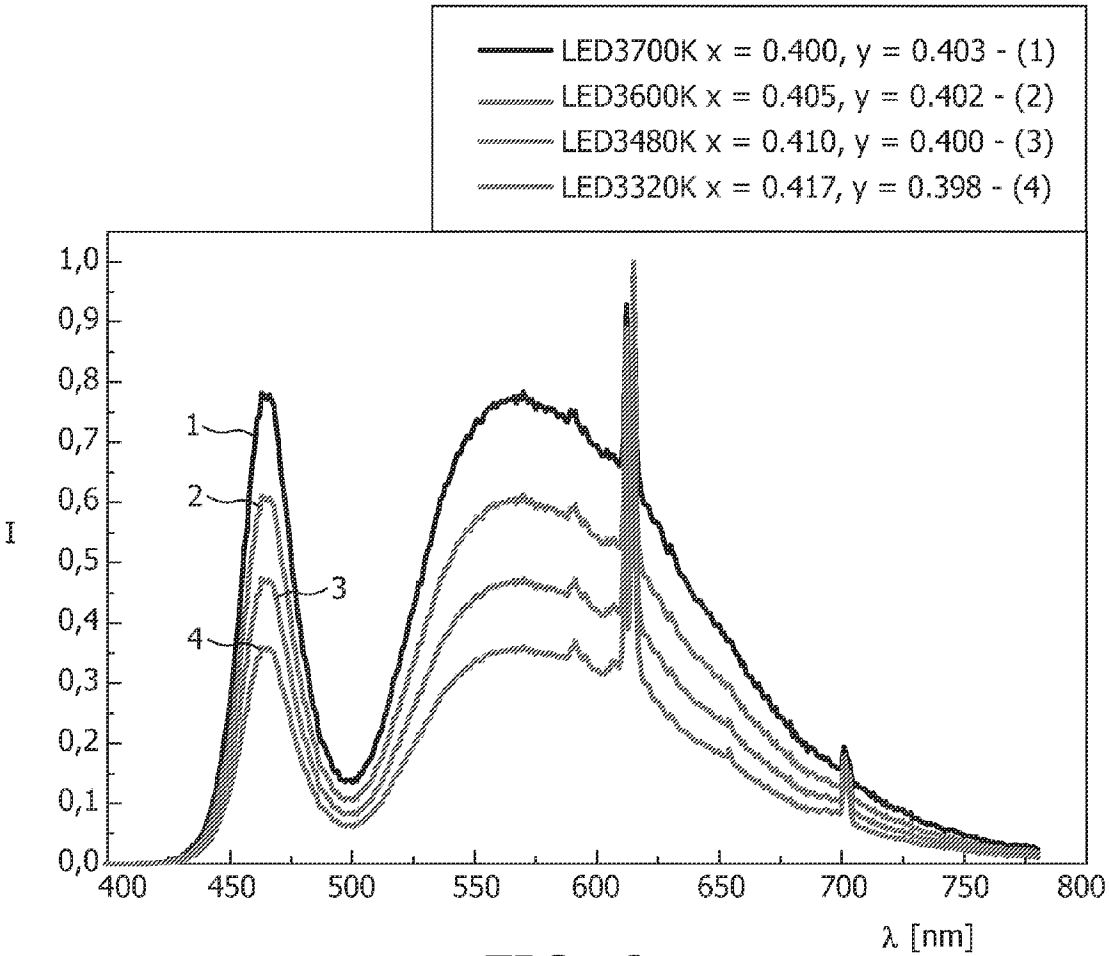

FIG. 6 shows emission spectra of such a white LED light source with white emitting phosphor converted (In,Ga)N LEDs comprising an $(Y,Gd)_3Al_5O_{12}$:Ce phosphor, 395 nm emitting (In,Ga)N LEDs, and a luminescent layer comprising $LiEuMo_2O_8$ as function of the driving conditions. Dimming the white pcLEDs reduces the color temperature, since the flux of the 395 nm UV LEDs, which mainly excites the $LiEuMo_2O_8$ phosphor, remains the same. The color rendering index is for all color temperatures between 80 and 85.

An advantage of the described LED light sources is that they emit white light similar to that known from incandescent and halogen lamps and that reducing the driving current (dimming) shifts the color temperature of the lamps from cold-white to warm-white. This is especially advantageous for indoor lighting applications. Moreover, the luminous efficiency of such an LED light source is not significantly reduced due to dimming, thus in contrast to what is known from incandescent, halogen and fluorescent lamps (the efficiency of the LED might even increase towards lower drive currents whereas the electronics might become less efficient at very low dimming levels).

The described light sources are in particular applicable in those surroundings, where

- deep red, skin, brown, and/or beige colors have to be evenly rendered,
- a comfortable, e.g. candle light, atmosphere is of large importance, and/or
- an incandescent-lamp-like dimming behavior is required.

Finally it is pointed out that in the present application the term "comprising" does not exclude other elements or steps, that "a" or "an" does not exclude a plurality, and that a single processor or other unit may fulfill the functions of several means. The invention resides in each and every novel characteristic feature and each and every combination of characteristic features. Moreover, reference signs in the claims shall not be construed as limiting their scope.

The invention claimed is:

1. An LED light source emitting white light, the light source comprising:

- a transparent bulb;
- at least one first LED emitting light in a first spectrum comprising near UV spectrum;
- at least one second LED for emitting light in a second spectrum different from the first spectrum,
- at least one controller coupled to the at least one first LED and the at least one second LED and configured to selectively and independently control intensity of the light emitted thereby so as to controllably vary one or more attributes of total light generated by the light source, and
- a luminescent layer disposed on the surface of the bulb and for being irradiated by the at least one first LED emitting and the at least one second LED, the luminescent layer comprises a red emitting luminescent material, wherein the at least one first LED, the at least one second LED, the at least one controller and the luminescent layer are constrained to implement a red shift of said white light when the light source is dimmed.

2. The LED light source according to claim 1, wherein the bulb is at least partly covered with a reflective coating.

3. The LED light source according to claim 1, wherein the bulb (40) has the GLS-like shape or a conical shape.

4. The LED light source according to claim 1, wherein the at least one first LED emitting and the at least one second LED are mounted on a heat sink.

5. The LED light source according to claim 1, wherein the near UV spectrum is a spectrum that has an emission peak in the range of about 370 nm to 400 nm.

6. The LED light source according to claim 1, wherein the second LED is a blue emitting LED with an emission peak in the range of about 400 nm to 480 nm, or a green emitting LED with an emission peak in the range of about 520 to 560 nm.

7. The LED light source according to claim 1, wherein the second LED is a white-emitting phosphor-converted LED or a green-emitting phosphor-converted LED.

8. The LED light source according to claim 1, wherein the luminescent layer is configured to absorb and convert light with the emission spectrum of one of the at least one first LED and the at least one second LED.

9. The LED light source according to claim 1, wherein the red emitting luminescent material comprises a composition in accordance to the general formulas $(Sr_{1-x-y}Ca_xBa_y)_{2-z}Si_5N_8$:$Eu_z$ ($0 \le x \le 1$, $0 \le y \le 1$, $0.1 \le z \le 2$), $(Sr_{1-x}Ca_x)S$:Eu ($0 \le x \le 1$), $(Sr_{1-x-y}Ca_xBa_y)_{3-z}Si_2N_2O_4$:$Eu_z$ ($0 \le x \le 1$, $0 \le y \le 1$, $0.1 \le z \le 3$), $CaAlSiN_3$:Eu, $MLn_{1-z}(Mo_{1-x}W_x)_2O_8$:$Eu_z$ (with M=Li, Na, K, Rb, Cs and Ln=Y, La, Ga and $0 \le x \le 1$, $0.1 \le z \le 1$), $Ln_{2-z}(Mo_{1-x}W_x)_2O_9$:$Eu_z$ (with Ln=La, Gd, Lu and $0 \le x \le 1$, $0.2 \le z \le 2$), or $Ln_{2-z}(Mo_{1-x}W_x)_3O_{12}$:$Eu_z$ (with Ln=La, Gd, Lu and $0 \le x \le 1$, $0.2 \le z \le 2$).

10. An LED light source emitting white light, the light source comprising:

a transparent bulb;

at least one first LED emitting light in a first spectrum;

at least one second LED for emitting light in a second spectrum different from the first spectrum, at least one controller coupled to the at least one first LED and the at least one second LED and configured to selectively and independently control intensity of the light emitted thereby so as to controllably vary one or more attributes of total light generated by the light source, and a luminescent layer disposed on the surface of the bulb and for being irradiated by the at least one first LED emitting and the at least one second LED, the luminescent layer comprises a green-to-yellow-emitting luminescent material, wherein the at least one first LED, the at least one second LED and the luminescent layer are constrained to implement a red shift of said white light when the light source is dimmed.

11. The LED light source according to claim 10, wherein the luminescent material comprises a composition in accordance to the general formulas $(Sr_{1-x-y}Ca_xBa_y)_2SiO_4$:Eu ($0 \le x \le 1$, $0 \le y \le 1$), $(Sr_{1-x}Ca_x)Si_2N_2O_2$:Eu ($0 \le x \le 1$), $SrLi_2SiO_4$:Eu, $(Y_{1-x-y-z}Lu_xGd_yTb_z)_3(Al_{1-a}Ga_a)_5O_{12}$:Ce ($0 \le a \le 1$, $0 \le x \le 1$, $0 \le y \le 1$, $0 \le z \le 1$), $Y_3Al_{5-x}Si_xO_{12-x}N_x$:Ce, or $CaAlSiN_3$:Ce.

12. The LED light source according to claim 10, wherein the bulb is at least partly covered with a reflective coating.

13. The LED light source according to claim 10, wherein the bulb (40) has the GLS-like shape or a conical shape.

14. The LED light source according to claim 10, wherein the at least one first LED has an emission peak in the range of about 370 nm to 400 nm.

15. The LED light source according to claim 10, wherein the second LED is a blue emitting LED with an emission peak in the range of about 400 nm to 480 nm, or a green emitting LED with an emission peak in the range of about 520 to 560 nm.

16. The LED light source according to claim 10, wherein the luminescent layer is configured to absorb and convert light with the emission spectrum of one of the at least one first LED and the at least one second LED.

* * * * *